US005611708A

United States Patent [19]

Mizunuma et al.

[11] Patent Number: 5,611,708

[45] Date of Patent: Mar. 18, 1997

[54] ELECTRIC CONNECTOR

[75] Inventors: Yasuyuki Mizunuma; Katsuhiro Nozawa, both of Tokyo, Japan

[73] Assignee: DDK Ltd., Japan

[21] Appl. No.: 501,607

[22] Filed: Jul. 12, 1995

[51] Int. Cl.[6] ..... H01R 13/73

[52] U.S. Cl. ..... 439/358; 439/357

[58] Field of Search ..... 439/350, 351, 439/352, 353, 354, 355, 357, 358, 607, 610

[56] References Cited

U.S. PATENT DOCUMENTS

| | | | |
|---|---|---|---|
| 4,113,179 | 9/1978 | McKee | 439/354 |
| 5,011,424 | 4/1991 | Simmons | 439/352 |
| 5,178,556 | 1/1993 | Chen | 439/357 |
| 5,201,669 | 4/1993 | Lin | 439/357 |

*Primary Examiner*—Hien Vu

*Attorney, Agent, or Firm*—Silverman, Cass & Singer, Ltd.

[57] ABSTRACT

An electrical connector having a locking member which includes at one end an anchoring part shaped for hooking a mating connector, an engagement part to be secured to one of projections provided on both sides of a shell enclosing a main connector body, and at the other end a knob portion having a leaf spring. The engagement part is positioned between the anchoring part and the knob portion. The engagement part has a protrusion near to the center of the width of one end adjacent the knob portion, and two plate pieces on both the sides of the protrusion. Each of the plate pieces has a free end in the form of a resilient cantilever directing toward the protrusion. The spacing between the free ends of the two plate pieces is less than the width of the projection of the shell.

6 Claims, 4 Drawing Sheets

ELECTRIC CONNECTOR

BACKGROUND OF THE INVENTION

This invention relates to an electrical connector, and more particularly to an electrical connector having a locking member for an interface connector used for connecting between electronic appliances by an electric cable.

Prior art connectors having locking members will be explained referring to FIGS. 4*a* to 4*d* and FIGS. 5*a* and 5*b*.

The interface connector 64 is mostly composed of a main body 34, shells 36 and 30, locking members 46, and a hood 48. While the hood 48 formed as a single piece is shown in FIG. 4*a*, any other various configurations may be used instead of the shown hood, for example, a hood consisting of two halves (not shown) enclosing the shells, or instead of the hood a cover made of a plastic material, such as polyvinyl chloride integrally molded on the shells. The hood is made of a plastic material such as ABS. Although the hood as shown by numeral 48 is generally used to cover the shells 36 and 30 at present, the cover of polyvinyl chloride integrally molded on shells has been progressively widely used instead of the hood 48. Such a cover serves to obtain an appropriate flexibility of its cable holding portion 42 (FIG. 5*a*), inasmuch as its material is substantially the same as that of the sheath of the cable 44.

One example of the size of the interface connector 64 is a height of 11.5 mm, a length of 44 mm and a width which is variable depending upon the contact pitch and the number of cores.

Assembling steps of the interface connector 64 will be briefly explained with reference to FIGS. 4*a* to 4*d* and 5*a* and 5*b*. A cable 44 preconditioned for connection is connected to the main body 34 by pressure-welding, butt-welding, soldering or the like. The main body 34 thus connected to the cable 44 is mounted in the shell 30 on which the shell 36 is then arranged and fixed thereto. Thereafter, the shells are subjected to calking at their portions adjacent to the cable. In the type of the connector (FIG. 5*a*) to be covered by the hood 48, the locking members 46 are mounted on the shell 36 on which in turn the hood 48 is then fitted. Whereas, in the type of the connector (FIG. 5*b*) to have an integrally molded cover, a plastic material such as polyvinyl chloride is integrally molded on the shells to form a cover and then the locking members 46 are mounted on the shell 36.

The shells 36 and 30 are made of a metal such as steel sheet worked by sheet metal processing and have a thickness of 0.5 mm.

How to mount the locking members 46 onto the shell 36 will be explained. The L-shaped aperture 62 of the locking member 46 is engaged on the projection 32 of the shell 36. After the projection 32 of the shell 36 has been inserted into the L-shaped aperture 62 of the locking member 46 as shown in FIG. 4*c*, the locking member 46 is once shifted in the direction C (FIG. 4*d*) and the locking member 46 in this state is then shifted in the direction D through a slight distance of the order of 2 mm, thereby mounting the locking member 46 on the shell 36. Another locking member 46 can also be mounted on the shell 36 on the opposite side in the same manner.

The locking member 46 comprises a knob portion 54, an engagement part 56 and an anchoring part 58. The engagement part 56 and the anchoring part 58 are made of a metal such as a steel sheet and have the thickness of 0.5 mm. The engagement part 56 includes the L-shaped aperture 62 for mounting the locking member 46 on the shell 30 and the anchoring part 58 includes protrusions 60 for hooking a mating connector (receptacle). The knob portion 54 is made of a plastic material such as ABS and formed by insert molding with the metal portion of the locking member 46.

FIG. 5*b* illustrates the connector immediately after the cover 40 has been integrally molded on the shells 36 and 30 but the locking members are not yet mounted. FIG. 5*b* also illustrates the state that a connector fitted with a hood 48 has detached the locking members therefrom. Starting from the state shown in FIG. 5*b*, the locking members are inserted into openings 31 of the hood 48 or integrally molded cover 40 so as to cause the engagement parts of the locking members to engage protrusions 32 of the shell 36. The opening 31 of the hood 48 or cover 40 has a height of the order of 9.5 mm viewed in FIG. 5*b* and a width perpendicular thereto of the order of 2 mm. The locking members have a height of the order of 9 mm and their engaging portions to be inserted into the hood have a thickness of the order of 1.5 mm.

With the above construction for mounting the locking members, it is required to move them in the two directions C and D for mounting the locking members on the shell as shown in FIG. 4*d*. In the case of the integral hood 48 or a split type hood consisting of two halves (not shown), after the locking members 46 have been mounted on the shells, the hood can be fitted thereon without any problem. In the case of the cover 40 integrally molded on the shells 36 and 30, however, if the locking members were mounted on the shells before molding the cover 40, the locking members would be immovably fixed thereat by the plastic material. It is therefore impossible to mount the locking members on the shells prior to the molding of the cover. On the other hand, in the case of using the hood 48, the mounting of the locking members after fitting of the hood is also impossible.

In more detail, the opening 31 of the hood 48 or integrally molded cover 40 is only slightly larger than the locking member 46 to leave the clearance therebetween of the order of 0.5 mm as described above, and the locking member is required to be moved in the two directions in its mounting operation within such a narrow clearance, these making it impossible to mount the locking members on the connector after the hood has been fitted or the cover has integrally molded. As can be seen from the above, the mounting method of the locking members of the prior art could not be applied to an interface connector using the integrally molded cover 40 or a connector already fitted with a hood 48.

SUMMARY OF THE INVENTION

It is an object of the invention to provide an electrical connector having a locking member including an integrally molded cover, which is able to be mounted on the connector even after the cover has been integrally molded on the connector.

In order to accomplish the above object readily, the locking member for a connector according to the invention is constructed in the following manner.

The locking member 10 for a connector according to the invention consists of an anchoring part 16, an engagement part 14 and a knob portion 12. The engagement part 14 is positioned between the anchoring part 16 and the knob portion 12. The anchoring part 16 has one end shaped for hooking a mating connector. The knob portion 12 has on its one side a leaf spring 26. The engagement part 14 is so constructed to be secured to one of projections 32 provided on both sides (of width direction or X direction in FIG. 1*a*) of a shell 30 enclosing a main connector body 34.

The engagement part 14 is provided with a protrusion 20 near to the center of its width (in Z direction in FIG. 1*a*) of one end adjacent the knob portion 12 and two plate pieces 18 on both the sides of the protrusion 20 in the width direction (in Z direction in FIG. 1*a*). Each of the plate pieces 18 has a free end in the form of a resilient cantilever directing toward the protrusion 20. The spacing between the free ends of the two plate pieces is less than the width of the projection 32 of the shell 30.

The invention is carried out in the following manner.

(1) An opening 22 is formed between the protrusion 20 provided on the engagement part 14 and the free ends of the two plate pieces 18. The opening 22 is so sized and shaped that the projection 32 of the shell 30 is fitted in the opening 22 without play.

(2) The free ends of the two plate pieces 18 are L-shaped and the protrusion 20 provided on the engagement part 14 is trapezoid. The protrusion 20 and the free ends of the two plate pieces 18 are so arranged that the opening 22 formed therebetween is U-shaped and having a size enabling the projection 32 of the shell 30 to be fitted in the opening 22 without play.

(3) The other ends of the plate pieces 18 are fixed to the locking member on the side of the anchoring part 16 and the other free ends are L-shaped. The protrusion 20 is trapezoid. The protrusion 20 and the free ends of the two plate pieces 18 are so arranged that the opening 22 formed therebetween is U-shaped and have a size enabling the projection 32 of the shell 30 to be fitted in the opening 22 without play.

The opening 22 may have any shape capable of receiving the projection 32 of the shell 30. Preferably, the shape of the opening 22 is able to receive the projection 32 and holds it immovably in all direction after received it. Further, the opening preferably has a shape commensurate with that of the projection 32 of the shell 30. If only these conditions are fulfilled, the protrusion 20 may be of any shape, such as trapezoid, rectangular, square, triangular, semicircular, circular or the like. The free ends of the plate pieces may also be of any shape commensurate with the shape of the protrusion 20. In addition, the projection 32 of the shell 30 is bent to form an L-shaped projection whose free end preferably extends in the direction in which a cable 44 extends from the connector in order to prevent the projection 32 from vertically moving after fitted in the opening 22.

In order to give a sufficient resilience (displaceability) to the free end of the plate piece 18 and to ensure a sufficient strength of its fixed end, a distance between the free and fixed ends of the plate piece 18 is preferably as longer as possible and hence the fixed end is positioned preferably as near to the anchoring part 16 as possible. The plate pieces 18 are required to be resilient so that the locking members 10 are generally made of phosphor bronze and stainless steel used for springs, beryllium copper or the like. The knob portion 12 has a plastic part molded integral with the metallic engagement and anchoring parts so that the plastic part is made of ABS, PBT, PA or the like which can be injection molded with low pressure.

The spacing between the free ends of the plate pieces 18 facing to the protrusion 20 is less than the width of the projection 32 of the shell 30. However, as the plate pieces 18 are resilient and in the form of cantilevers, the projection 32 of the shell 30 could readily force the free ends outwardly to ride over them into the opening 22. In other words, the locking member 10 can be easily mounted on the shell 30 only by inserting the locking member 10 in one direction (Y direction in FIG. 1*a*) into the connector.

As the simple insertion of the locking members 10 suffices to mount them on the shell according to the invention, they can be readily mounted on the connector even after a food 48 has been fitted on the connector. Even in the case that the locking members 10 must be mounted on the connector only after a cover instead of a hood has been integrally molded on the connector, the locking members 10 can be readily mounted and fixed onto the connector according to the invention.

The invention will be more fully understood by referring to the following detailed specification and claims taken in connection with the appended drawings.

DESCRIPTION OF THE PREFERRED EMBODIMENTS

Figure 1A:
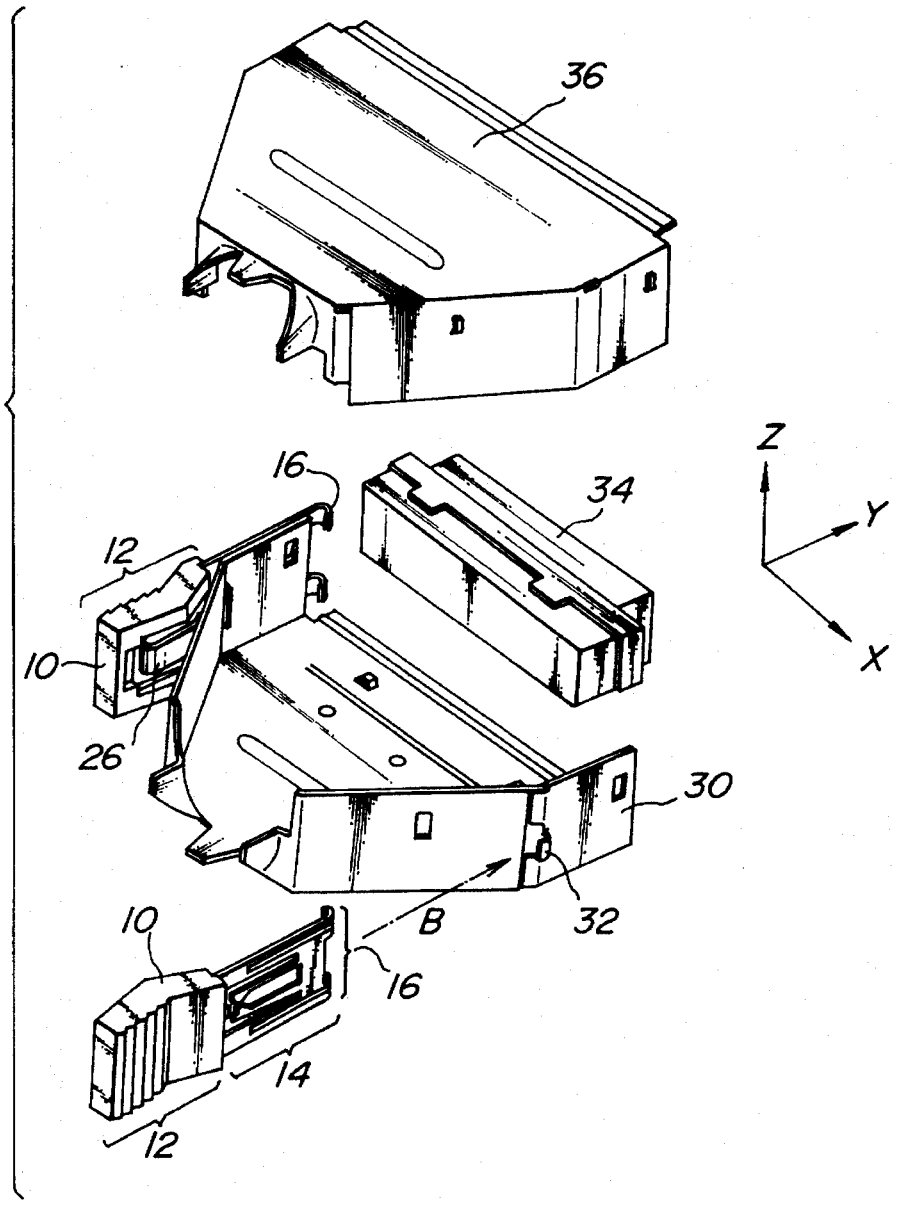
FIG. 1*a* is an exploded perspective view of a connector having locking members according to the invention.

FIGS. 1*a* to 1*c* and 2*a* and 2*b* illustrate the detailed construction of the locking member 10 according to the invention and the mounting method thereof. The locking member 10 comprises a knob portion 12, an engagement part 14 for engaging a shell 30, and an anchoring part 16 for hooking a mating connector. The locking member 10 is partly made of a plastic material and a metal such as stainless steel. The locking member 10 has a length of about 28 mm, a height of about 9 mm and a thickness of about 5 mm and its metallic part has a thickness of the order of 0.5 mm. The metallic part of the locking member is made of a stainless steel used for producing springs, because it is required to be resilient. The plastic part is made of ABS which can be injection molded with low pressure when the part is formed integrally with the metallic part by the injection molding.

The configurations and roles of the anchoring part 16, the engagement part 14 and the knob portion 12 will be explained hereinafter.

Figure 4A:
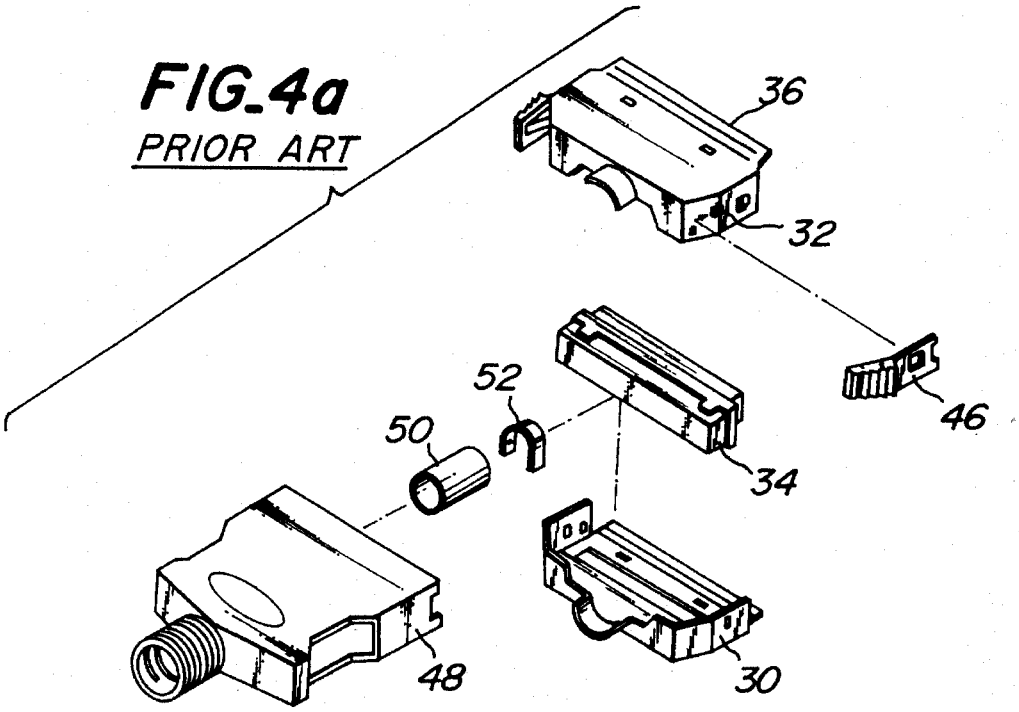
FIG 4a PRIOR ART
FIG. 4*a* is an exploded perspective view of a connector using locking members of the prior art.
Figure 4B:
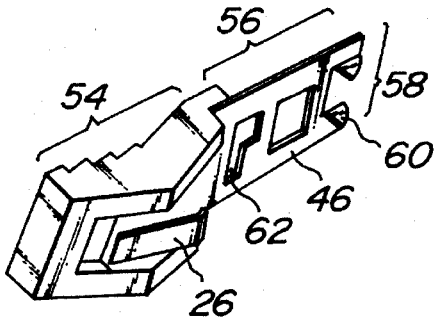
FIG 4b PRIOR ART
FIG. 4*b* is a perspective view of a locking member of the prior part.
Figure 4C:
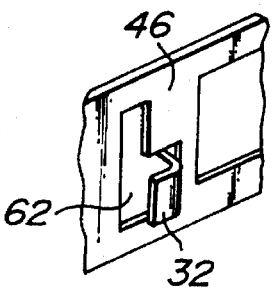
FIG 4c PRIOR ART
FIG. 4*c* is a partial perspective view of the locking member shown in FIG. 4*b* illustrating the first step for mounting it on the shell.
Figure 4D:
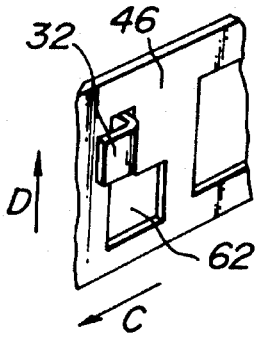
FIG 4d PRIOR ART
FIG. 4*d* is a partial perspective view of the locking member shown in FIG. 4*b* illustrating the next step for mounting it on the shell.
Figure 5A:
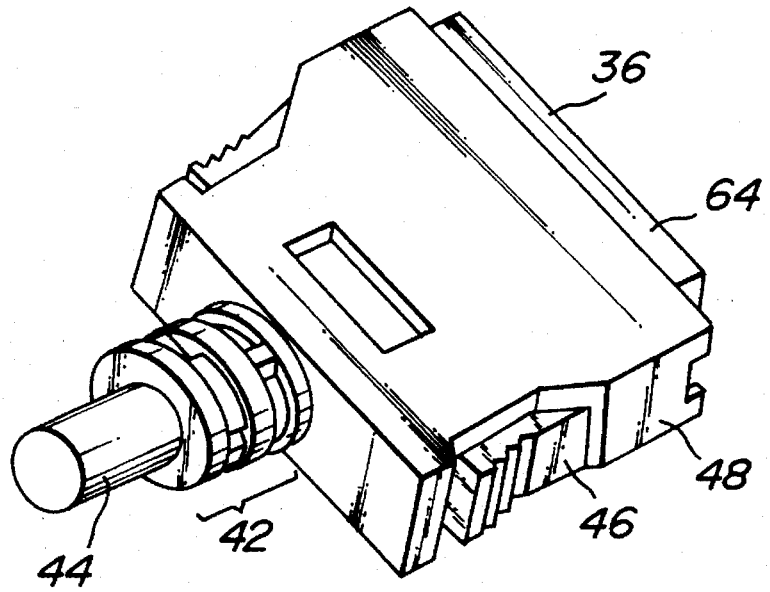
FIG 5a PRIOR ART
FIG. 5*a* is a perspective view illustrating a connector using the locking members of the prior art after completion of its assembly.
Figure 5B:
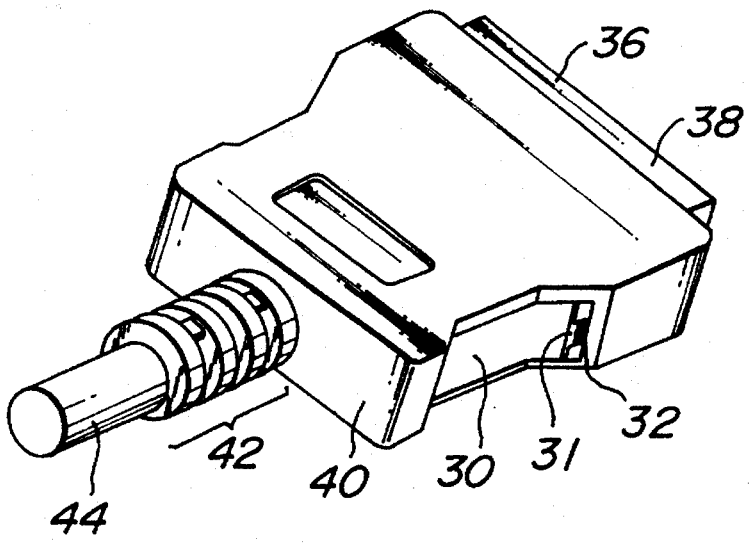
FIG. 5*b* is a perspective view illustrating a connector immediately after a cover has been integrally molded on the shell but before mounting of locking members thereon.

When the connector having the locking members is connected to a mating connector, the anchoring parts 16 firmly hook the mating connector to prevent any accidental disconnection between them. In the shown embodiment, the anchoring part 16 has two folded J-shaped parts one above the other (the vertical direction is shown by Z axis in FIG. 1*a*). As an alternative, the end of the anchoring part may be folded along its entire height to form a single J-shaped part, or the shape of the protrusion 60 of the prior art shown in FIG. 4*b* may be employed. In other word, any shape may be used as the anchoring part 16, so long as it can firmly hook a mating connector and be unhooked therefrom by operation of its knob portion 12. The folded extent of the J-shaped part is not critical as long as it serves as a hook, but depending upon the size and fitted strength of the connectors. The bend of the J-shaped part in this embodiment extends about 1 to 2 mm. The protrusion 60 may extend about 1 to 2 mm, if used herein.

The engagement part 14 serves to mount the locking member 10 on the shell 30 with the aid of its projection 32 and may have any configuration so long as the locking member can be mounted on the shell 30 only by its movement in one direction. In the shown embodiment, the engagement part 14 is formed with a protrusion 20 and plate pieces 18 and with openings 22 and 28 between both the plate pieces 18.

Figure 1B:
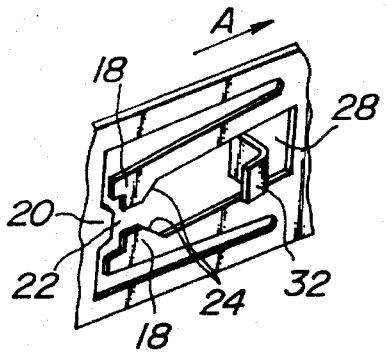
FIG. 1*b* is a partial perspective view of the locking member according to the invention illustrating the first step for mounting it on the shell.

The protrusion 20 is located at the center of its height (X direction in FIG. 1*a*) adjacent the knob portion 12 (FIG. 1*b*). The protrusion 20 extends a slight distance suitably selected to correspond to the projection 32 of the shell 30 described later so as to enable the protrusion 20 to engage the projection 32. In the shown embodiment, the extending distance of the protrusion 20 is of the order of 0.5 mm 1.5 mm.

The two plate pieces 18 is in the form of a resilient cantilever extending toward the protrusion 20. The protrusion 20 and the free ends of the plate pieces 18 form an opening 22 having a size and a shape receiving the projection 32 of the shell 30 without play. Therefore, when the projection 32 of the shell 30 is snugly fitted in the opening 22, the locking member does not wobble in all direction. The shape of the opening 22 corresponds to that of the projection 32 of the shell 30.

Figure 1C:
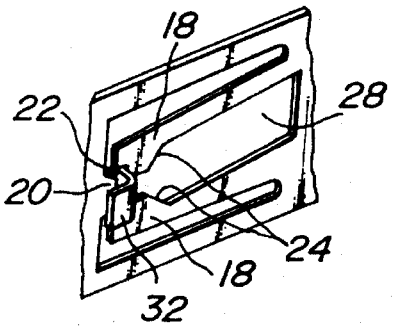
FIG. 1*c* is a partial perspective view of the locking member shown in FIG. 1*b* illustrating the next step for mounting it on the shell.

In the embodiment shown in FIGS. 1*a* to 1*c*, the projection 32 of the shell 30 is formed by bending a square part into an L-shaped hook. The shape of the projection 32 may be circular, triangular, rectangular or the like. However, the shape shown in the drawing is preferable in view of the fact that it is firmly held in the opening 22 and easily produced.

While the L-shaped free ends of the plate pieces 18, the trapezoid protrusion 20 and the U-shaped opening 22 are shown in FIG. 1*b*, it will be apparent that these parts may have any shapes other than those shown so long as the projection 32 can be firmly held without play. Preferably, these parts have the shapes commensurate with that of the projection 32 of the shell 30. In this case, the distance between the free ends of the two plate pieces 18 is determined according to and slightly less than the width (Z direction in FIG. 1*a*) of the projection 32. This distance is of the order of 1.5 to 2.5 mm in the shown embodiment. About 0.5 mm to 1 mm is sufficient as a length of the hooked portions of the free ends of the plate pieces 18 on the projection 32 of the shell 30. Two plate pieces 18 extend substantially parallel to each other from the anchoring part 16.

Figure 2A:
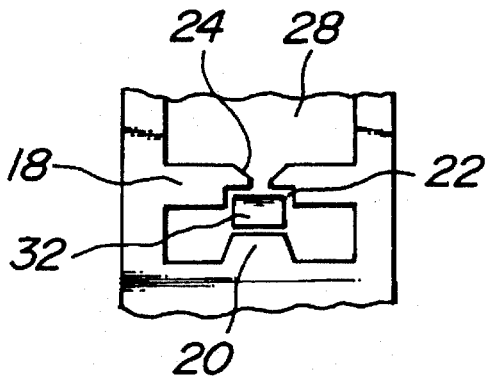
FIGS. 2*a* and 2*b* are partial plan views showing second and third embodiments of the locking member according to the invention, respectively.
Figure 2B:
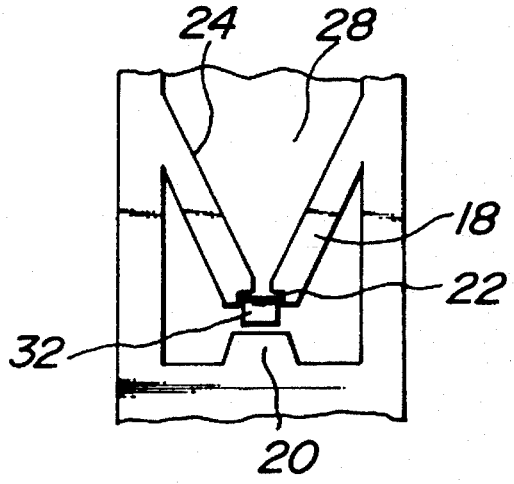

Other embodiments are shown in FIGS. 2*a* and 2*b*, wherein the fixed ends of the plate pieces 18 are modified. In the second embodiment shown in FIG. 2*a*, the fixed ends of the plate pieces 18 are positioned at a distance 2 to 3 mm spaced from the protrusion 20 and the two plate pieces are aligned with each other in their longitudinal axial direction. In the third embodiment shown in FIG. 2*b*, the plate pieces 18 are arranged in the form of a V letter, whose fixed ends are positioned on the side of the anchoring part 16.

While the plate piece 10 is shown in symmetry with respect to its longitudinal center axis in the each shown embodiment, any asymmetrical arrangement may be used as long as the protrusion 20 and the free ends of the plate pieces 18 fulfill the above requirement.

The knob portion 12 comprises a main body integrally made of a plastic material and a leaf spring 26 provided on the surface of the main body facing to the knob portion 12 of the other locking member 10. The knob portion 12 is molded by the plastic material integral with the other metallic parts of the locking member 10 in order to improve its appearance quality and to make it possible to push the knob parts of the two locking members inwardly toward each other by two fingers of a user when connecting two connectors. It is enough for the knob portion 12 to have a size allowing the finger to push it. While the leaf spring 26 is always pushed against the shell 30 in the embodiment shown in FIG. 1*a*, any other spring different in shape and pushed condition may be used if it could accomplish its required performance described hereafter.

Figure 3:
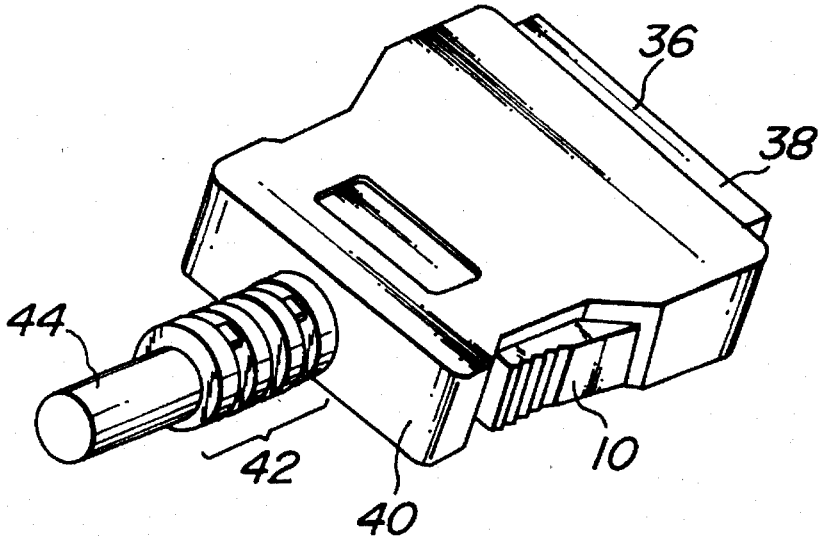
FIG. 3 is a perspective view illustrating a connector having an integrally molded cover and locking members according to the invention mounted after the cover has been integrally molded.

In order to connect a connector 38 as shown in FIG. 3 to a mating connector, the knob portions 12 of the locking members 10 on both the sides are pushed inwardly toward each other by fingers of a user to open the anchoring parts 16 away from each other. The connector 38 with the locking members 10 in this state are then fitted with the mating connector and when the connection has been completed, the knob portions 12 of the locking members 10 are released so that the locking members 10 are returned to their original positions by the force of the leaf springs 26 with the result that the anchoring parts 16 hook the mating connector to fix both the connectors to each other.

Finally, the method for mounting the locking members 10 on the shell 30 according to the invention will be explained with referring to FIGS. 1*a* to 1*c*. This method can also be carried out in the second and third embodiments in the same manner as described herein. The locking member 10 is moved in the direction shown by an arrow B in FIG. 1*a* in a manner that the projection 32 of the shell is first inserted into the opening 28 of the locking member 10 (FIG. 1*b*). Under this condition, the locking member 10 is further pushed in the direction shown by an arrow A in FIG. 1*b* so that the projection 32 of the shell 30 advances between the two plate pieces 18 and then along the inclined faces 24 of the plate pieces 18 with the result that the resilient plate pieces 18 are urged outwardly away from each other to allow the projection 32 to snap into the opening 22 where projection 32 is fixed.

While the invention has been particularly shown and described with reference to preferred embodiments thereof, it will be understood by those skilled in the art that the foregoing and other changes in form and details can be made therein without departing from the spirit and scope of the invention.

What is claimed is:

1. An electrical connector comprising, a locking member, said locking member including at one end having an anchoring part shaped for hooking a mating connector, an engagement part to be secured to a projection provided on a side of a shell enclosing a main connector body, a knob portion having a leaf spring formed at the other end of the locking member, said engagement part being positioned between said anchoring part and said knob portion, said engagement part having a width and including a protrusion formed thereon proximate the center of the width of the engagement part adjacent to said knob portion, and two plate pieces positioned on respective opposite sides of said protrusion, each of said plate pieces having a free end in a form of a resilient cantilever extending toward said protrusion, the protrusion having a width, a spacing between the free ends of said two plate pieces being less than the width of said protrusion, said free ends of said two plate pieces being generally L-shaped and said protrusion being generally trapezoid shaped, and wherein said protrusion and said free ends of said two plate pieces are arranged so that an opening formed therebetween is U-shaped and has a size enabling said projection of said shell to be fitted in said opening without play.

2. The electrical connector as set forth in claim 1, wherein an opening formed between said protrusion and said free ends of said two plate pieces has a shape commensurate with that of said projection of the shell to receive said projection within said opening.

3. The electrical connector as set forth in claim 1, wherein said projection of the shell is an L-shaped projection whose free end extending in the direction in which a cable extends from the connector.

4. The electrical connector as set forth in claim 1, wherein said plate pieces are made of a resilient material selected from the group consisting of phosphor bronze and stainless steel used for springs, beryllium copper or the like.

5. The electrical connector as set forth in claim 1, wherein other ends of said plate pieces opposite said free ends are connected to said anchoring part.

6. The electrical connector as set forth in claim 1, wherein said knob portion has a plastic part molded thereon.

* * * * *

UNITED STATES PATENT AND TRADEMARK OFFICE

CERTIFICATE OF CORRECTION

PATENT NO. : 5,611,708

DATED : March 18, 1997

INVENTOR(S) : Yasuyuki Mizunuma et al.

It is certified that error appears in the above-indentified patent and that said Letters Patent is hereby corrected as shown below:

On the title page: Item [54]and column 1, line 1,

Title: Change "ELECTRIC" to --ELECTRICAL--;

Col. 8,

Claim 3, line 3, change "extending" to --extends--.

Signed and Sealed this

Seventeenth Day of June, 1997

Bruce Lehman

*Attest:*

BRUCE LEHMAN

*Attesting Officer*

*Commissioner of Patents and Trademarks*